US009719402B2

(12) United States Patent
Wade et al.

(10) Patent No.: US 9,719,402 B2
(45) Date of Patent: Aug. 1, 2017

(54) EXHAUST RUNNER COLLAR

(71) Applicant: Ford Global Technologies, LLC, Dearborn, MI (US)

(72) Inventors: Robert Andrew Wade, Plymouth, MI (US); David Krenk, Canton, MI (US); Zikun Lu, Canton, MI (US); Brian Siwek, Commerce Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 55 days.

(21) Appl. No.: 14/858,914

(22) Filed: Sep. 18, 2015

(65) Prior Publication Data

US 2017/0082010 A1 Mar. 23, 2017

(51) Int. Cl.

| | |
|---|---|
| ***F01N 3/02*** | (2006.01) |
| ***F01N 13/18*** | (2010.01) |
| ***F01N 13/10*** | (2010.01) |

(52) U.S. Cl.

CPC ..... *F01N 13/1811* (2013.01); *F01N 13/10* (2013.01)

(58) Field of Classification Search

CPC ..... F01N 13/1811; F01N 13/10
USPC ..... 60/320
See application file for complete search history.

(56) References Cited

U.S. PATENT DOCUMENTS

| | | | | |
|---|---|---|---|---|
| 4,545,605 | A | 10/1985 | Gerber et al. | |
| 4,832,383 | A | 5/1989 | Roussel | |
| 5,349,817 | A | 9/1994 | Bekkering | |
| 5,596,961 | A * | 1/1997 | Faber | F02F 7/006 123/184.38 |
| 5,727,386 | A | 3/1998 | Watanabe et al. | |
| 6,293,098 | B1 | 9/2001 | Coates | |
| 8,733,088 | B2 | 5/2014 | Reinhart et al. | |
| 2005/0268602 | A1 * | 12/2005 | Smatloch | F01N 13/10 60/323 |
| 2006/0170214 | A1 * | 8/2006 | Valente | F16L 23/036 285/412 |
| 2007/0062182 | A1 | 3/2007 | Westerbeke, Jr. | |
| 2011/0131963 | A1 * | 6/2011 | Reinhart | F01N 3/046 60/321 |
| 2013/0025560 | A1 * | 1/2013 | Thomas | F02F 1/24 123/193.5 |
| 2014/0298780 | A1 * | 10/2014 | Hodgson | F01N 3/2066 60/298 |
| 2015/0033734 | A1 * | 2/2015 | Hazelton | F01N 13/1816 60/605.1 |
| 2015/0260077 | A1 * | 9/2015 | Steigert | F01N 3/02 60/321 |

* cited by examiner

*Primary Examiner* — Jason Shanske
(74) *Attorney, Agent, or Firm* — Greg Brown; McCoy Russell LLP

(57) ABSTRACT

Methods and systems are provided for a collar welded to a runner to manage stress in an exhaust manifold. In one example, a system may include welding a collar to a runner and a flange with an air gap located between the collar, the runner, and the flange.

16 Claims, 6 Drawing Sheets

500

600

EXHAUST RUNNER COLLAR

FIELD

The present description relates generally to systems for an exhaust runner collar.

BACKGROUND/SUMMARY

Engine performance may be increased by disabling exhaust gas communication between cylinders. This may be accomplished by an exhaust manifold comprising individual exhaust tubes (e.g., exhaust runners) for each cylinder. The exhaust runners remain separated, and therefore the exhaust gas remains separated before coming together at a collector. A longer separation can minimize exhaust pulse overlap and enable optimized valve timing.

However, exhaust runners are often longer with significant mass away from the engine in a cantilever configuration. Thus, the longer exhaust runners are prone to higher stress through a bending moment than other manifolds (e.g., cast iron log style exhaust manifolds). The higher stress increases a likelihood of degradation (e.g., single overload or fatigue cracking) at a junction between the exhaust runner and an inlet flange coupling the runner to the engine.

Other attempts to address stress in long exhaust runners include casting cores and adding brackets. Stress can also be managed through a welding geometry. One example approach is shown by Roussel et al. in U.S. Pat. No. 4,832,383. Therein, exhaust runners are welded to a flange of an engine in a circumferential direction via a chamfered weld. The weld allows the exhaust runner to more accurately fit into the inlet flange.

However, the inventors herein have recognized potential issues with such systems. As one example, the weld is unable to flex and/or bend under high engine vibration energy. Thus, the exhaust runner(s) are still prone to high stress generated via combustion and may result in a fatigue failure at the welded joint.

In one example, the issues described above may be addressed by a method for a runner having a runner wall interfacing with an inlet flange of a cylinder head and a collar positioned at the interface forming an annular air gap around an exterior of the runner. In this way, the collar may be able to flex in response to stresses generated by operating a vehicle and be less susceptible to a fatigue fracture and thus increase a longevity of the exhaust runner.

As one example, the collar is formed with a single wall extending from the inlet flange to the exhaust runner at respective positions spaced away from a corner of the interface. A geometry of the collar (e.g., L-shaped, I-shaped, square cross-section, and triangular cross-section) may increase stress load sharing via a spring-like flexibility of the collar. The air gap is interruptedly sealed at the respective positions via weld beads such that there are openings leading to the air gap from the engine or an ambient atmosphere. The air gap extends uninterruptedly fully around an outer circumference of the outer surface of the runner wall in one example. It will be appreciated by someone skilled in the art that the air gap may also be segmented (e.g., interrupted) according to a shape of the collar. In one embodiment, the collar may be welded to only a single runner of a plurality of runners in order to manage the stress across the runners. The single runner may be the shortest runner of the plurality of runners or a runner closest to a rear of a vehicle. Additionally or alternatively, the single runner may comprise a most acute bend or highest cantilever of the plurality of runners. In this way, the single runner, without the collar, may have a greatest likelihood of degradation compared to the plurality of runners. By welding the collar to the single runner, the collar may distribute a stress load received by the single runner such that the likelihood of degradation for the single runner is decreased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-4 are shown approximately to scale

DETAILED DESCRIPTION

Figure 1:
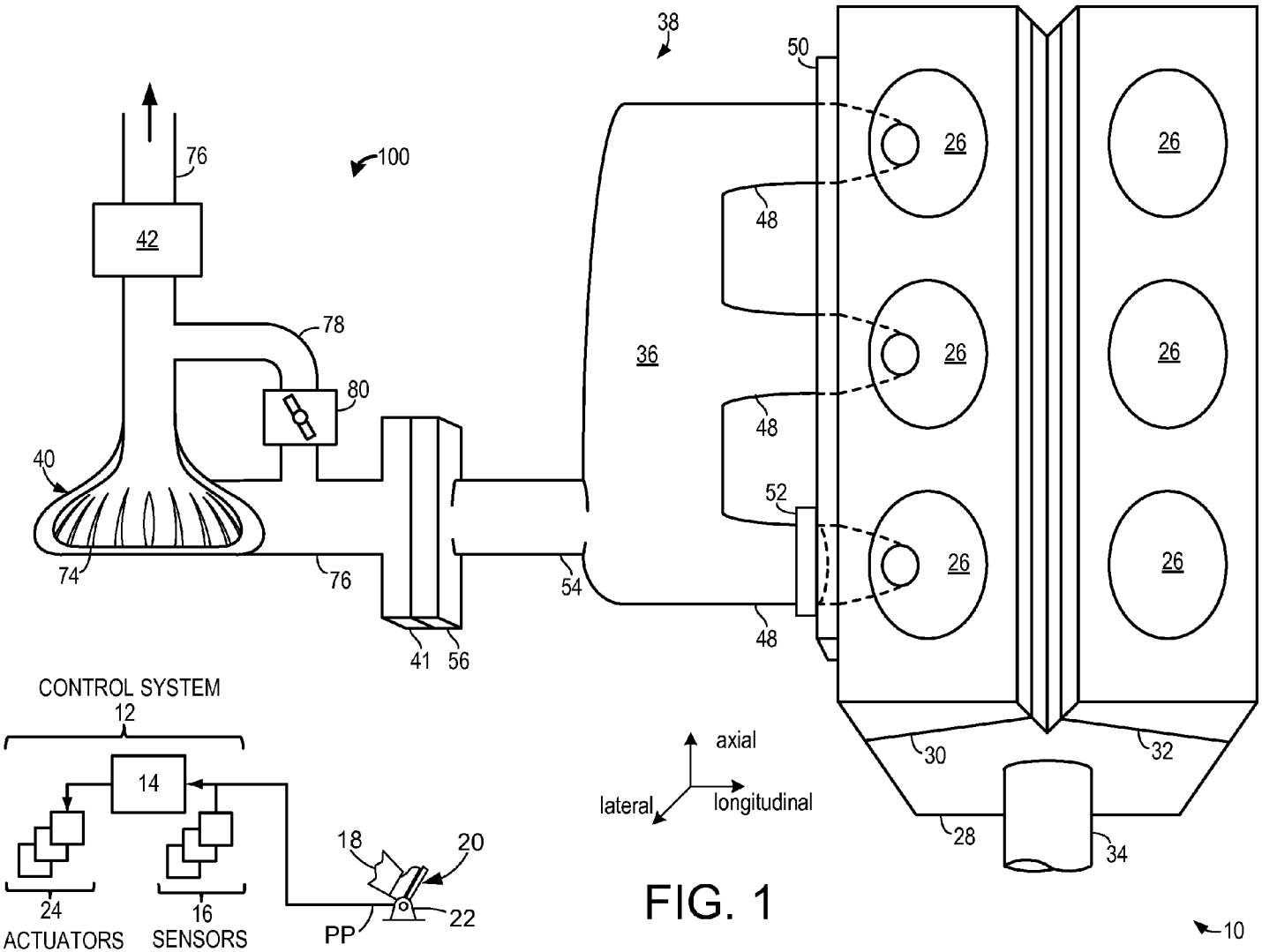
FIG. 1 shows an engine including an exhaust manifold system
Figure 2:
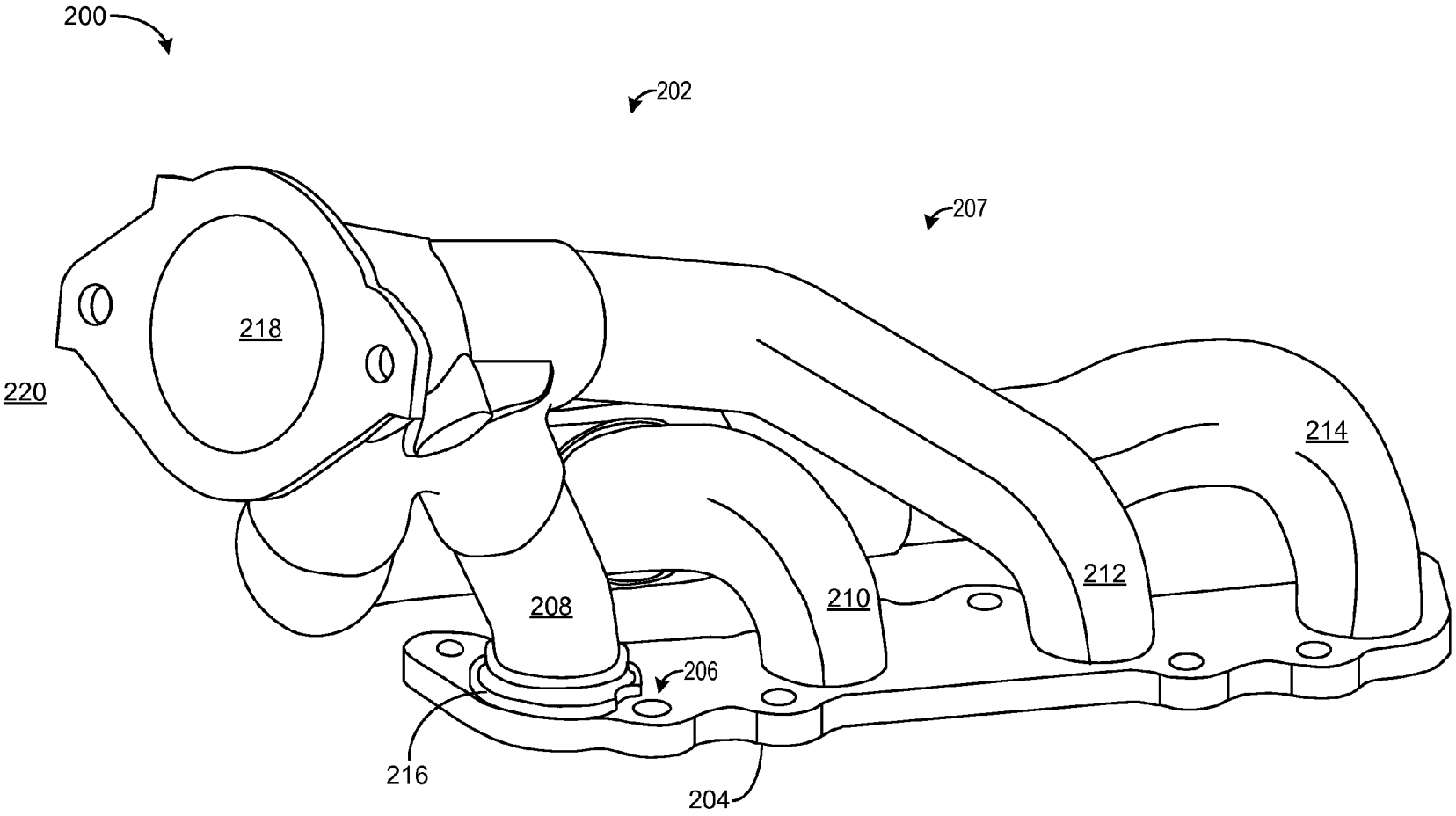
FIG. 2 shows a collar coupled to an exhaust runner.
Figure 3:
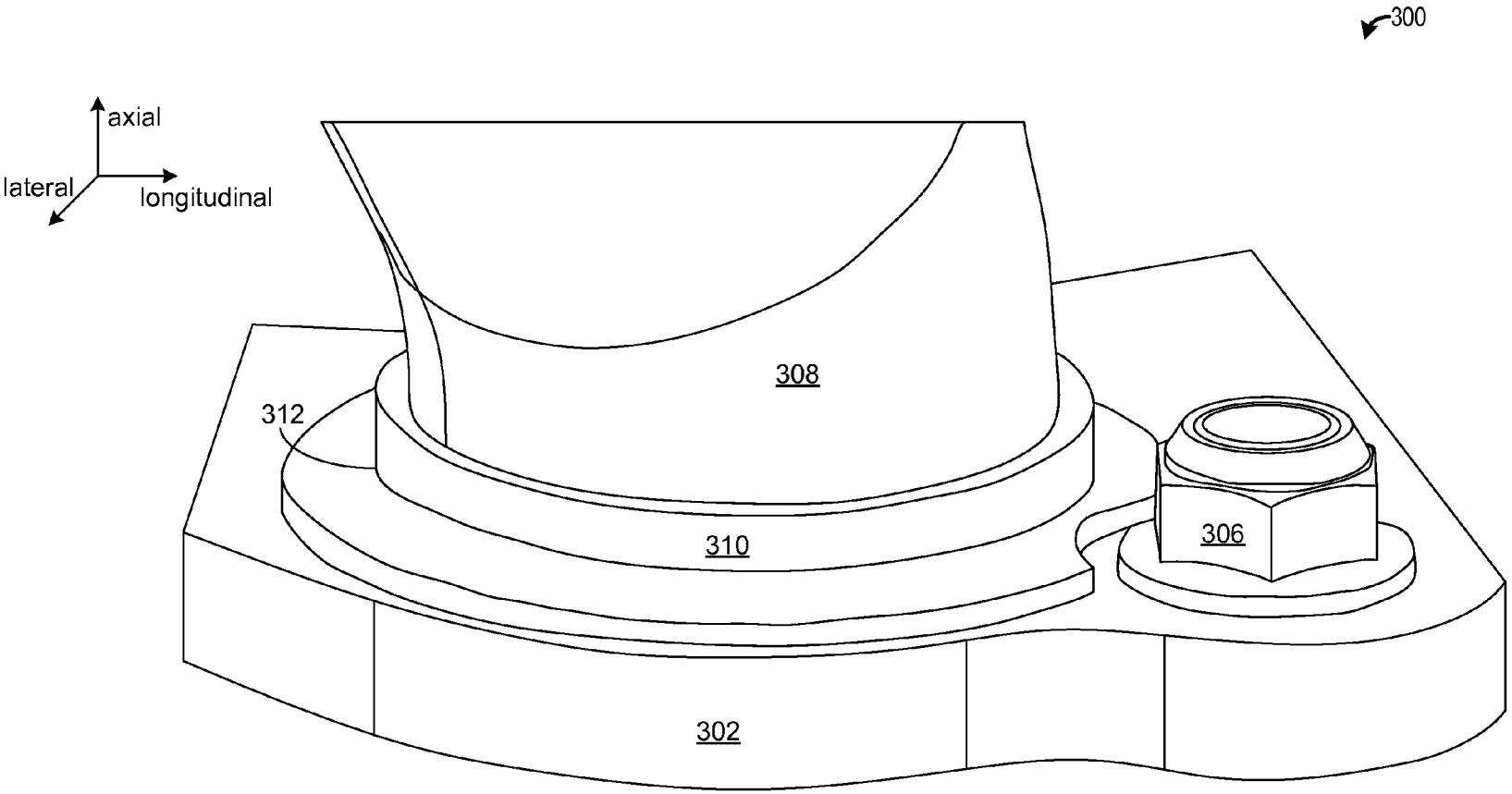
FIG. 3 shows a close-up depiction of a structure of the collar.
Figure 4:
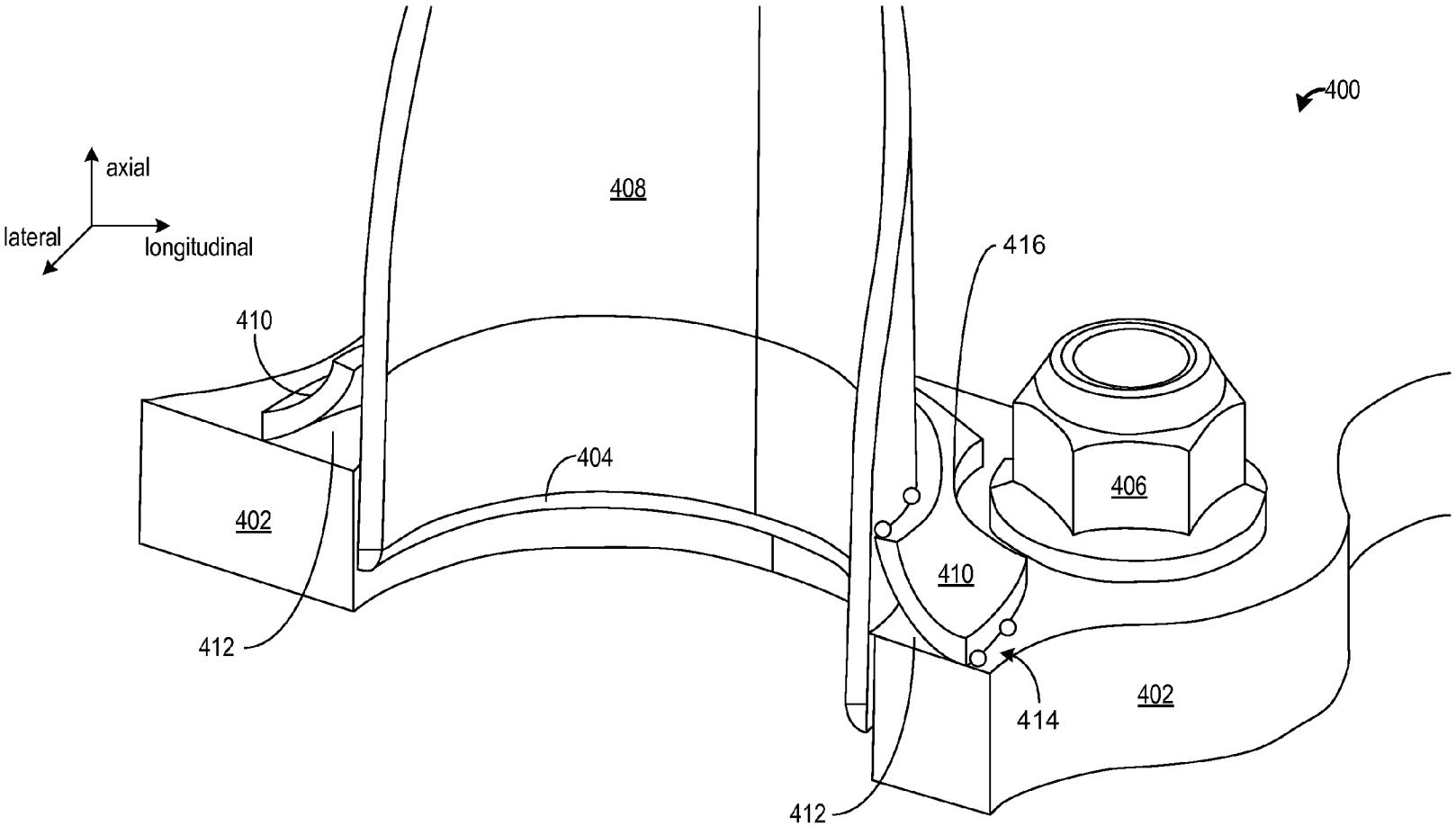
FIG. 4 shows a cross-section of the exhaust runner and the collar.
Figure 5:
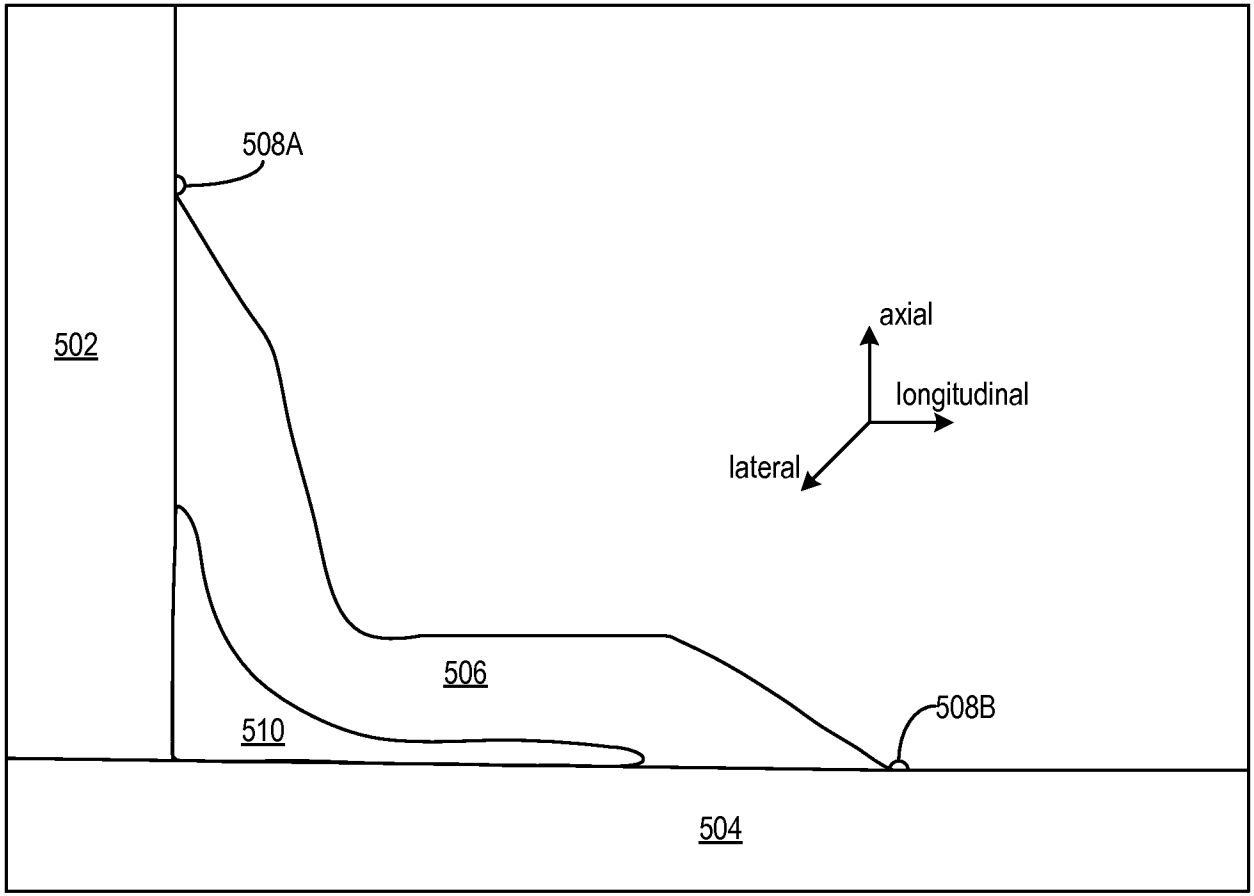
FIG. 5 shows a dissected view of the collar, the exhaust runner, and an inlet flange.
Figure 6:
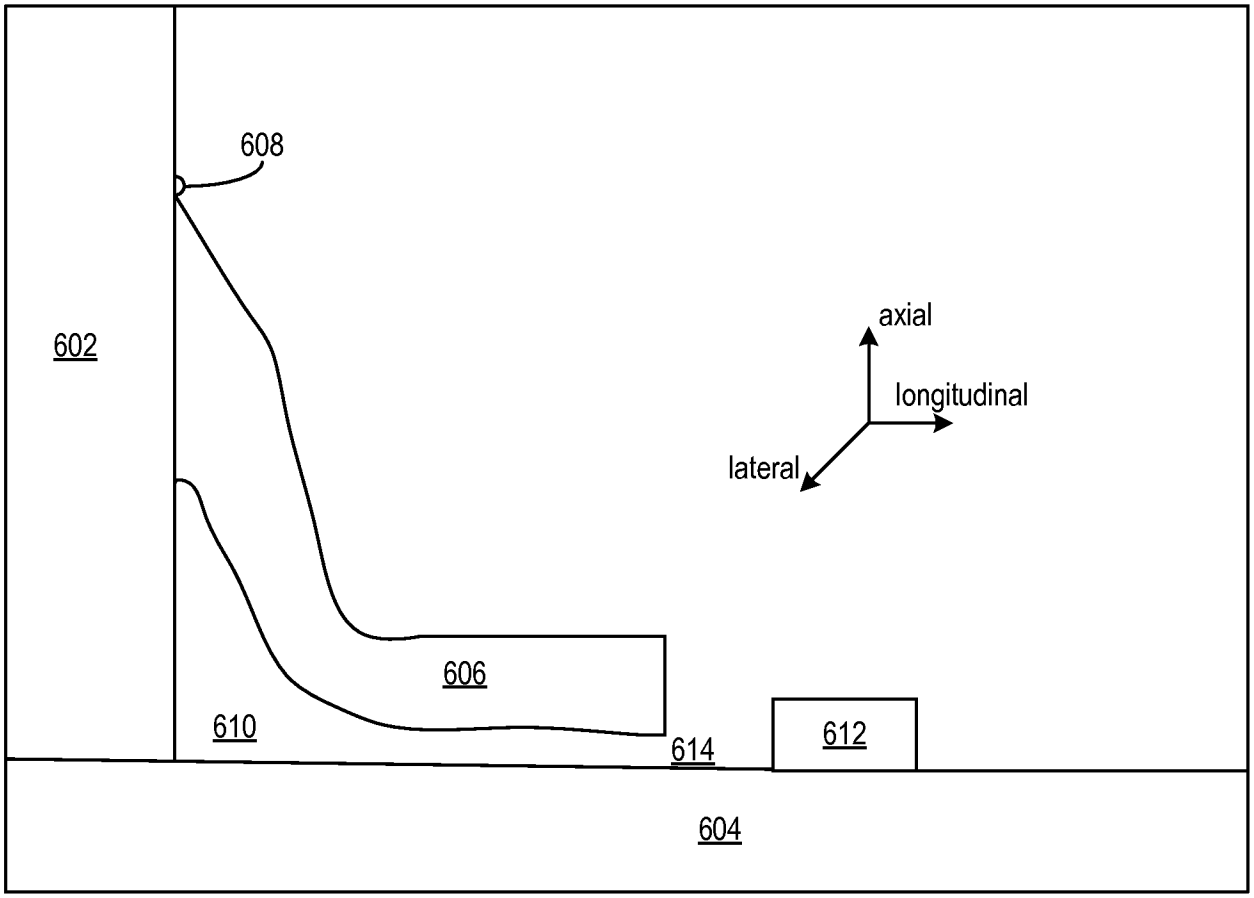
FIG. 6 shows a dissected view of the collar, the exhaust runner, and the inlet flange near a nut of the inlet flange.

The following description relates to a system for a collar coupled to an exhaust runner and an inlet flange. The collar is coupled to the inlet flange adjacent to an exhaust side of a combustion chamber of an engine, as shown in FIG. 1. An exhaust manifold of FIG. 1 comprising the collar is shown in more detail in FIG. 2. A close-up the collar coupled to the exhaust runner is shown in FIG. 3. A cross-section of the collar and the exhaust runner is shown in FIG. 4. A side-on two-dimensional view illustrating an air gap and shape of the collar is shown in FIGS. 5 and 6.

FIGS. 1-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example.

Turning now to FIG. 1, aspects of an example engine 10 are shown. Multi-cylinder engine 10 may be included in a propulsion system of an automobile. In the present example, engine 10 is shown in a V6 configuration, however further examples may include V8, V12, I4, I6, boxer, rotary, and additional engine configurations. Engine 10 may be a spark ignition engine or compression ignition engine (i.e., sparkless diesel engine).

Engine 10 may be controlled at least partially by a control system 12 including controller 14 and by input from sensors 16 and/or a vehicle operator 18 via an input device 20. In this example, input device 20 includes an accelerator pedal (e.g., the input device 20) and a pedal position sensor 22 for generating a proportional pedal position signal PP. Controller 14 outputs signals and commands to actuators 24 to control the operation of engine 10 and related systems.

A plurality of combustion chambers (cylinders) 26 is included in engine 10, each including combustion chamber walls with a piston positioned therein. Engine 10 includes an engine block 28 coupled to cylinder heads 30 and 32, the combustion chamber walls defined by the engine block 28, first cylinder head 30, and second cylinder head 32. Each piston may be coupled to crankshaft 34 so that reciprocating motion of each piston is translated into rotational motion of the crankshaft 34. Crankshaft 34 may be coupled to at least one drive wheel of a vehicle via an intermediate transmission system. Further, a starter motor may be coupled to crankshaft 34 via a flywheel to enable a starting operation of engine 10.

Each combustion chamber 26 may receive intake air from an intake manifold via an intake passage (not shown) and may exhaust combustion gases via an exhaust manifold 38. The intake manifold and exhaust manifold 38 can selectively communicate with combustion chambers 26 via respective intake valves and exhaust valves (not shown). In some embodiments, one or more of the combustion chambers 26 may include two or more intake valves and/or two or more exhaust valves. Engine intake valves and engine exhaust valves may be mechanically actuated (e.g., by an overhead cam), electro-magnetically actuated (e.g., EVA) or some combination of the two. Further, engine 10 may include port injection or direct injection in one or more of the plurality of combustion chambers 26.

In the present example, a first exhaust manifold 38 is only coupled to a first cylinder bank of first cylinder head 30. A second exhaust manifold (e.g., coupled to a second cylinder bank included in second cylinder head 32) is not shown for the sake of simplicity. However, a second exhaust manifold in a "V" configuration engine may be provided. Furthermore, the second exhaust manifold coupled to the second cylinder head 32 may be substantially identical to the first exhaust manifold 38 or it may be substantially different in packaging or architecture. The first exhaust manifold 38 is coupled to exhaust system 100. The second exhaust manifold may comprise a second exhaust system substantially similar to exhaust system 100. In one example, the exhaust manifold 38 may be a fabricated tubular header style manifold. In another example, the exhaust manifold 38 may be a cast log style manifold.

Exhaust manifold 38 includes an inlet flange 50 between first ends of a plurality of runners 48 and the first cylinder head 30. The exhaust runners 48 may be welded together to form the exhaust manifold 38. The inlet flange 50 is physically coupled to the first ends of the runners 48 on a first side (e.g., side facing the exhaust manifold 38). The inlet flange 50 is physically coupled to an exhaust side of the first cylinder head 30 via a second side, opposite the first side of the inlet flange 50. The inlet flange 50 fluidly couples the runners 48 to corresponding combustion chambers 26 such that exhaust gas expelled from the combustion chambers 26 flows into one of the corresponding exhaust runners 48.

Each of the runners 48 corresponds to an opening (e.g., an exhaust opening) of one of the cylinders 26. In other words, the first cylinder head 30 having a plurality of cylinder openings, wherein at least one of the cylinder openings corresponds to at least one of the exhaust runners 48. Each of the exhaust runners 48 of each of the cylinders 26 is separated from one another before leading to a common junction at a chamber (e.g., a collector) 36. The collector 36 of the exhaust manifold 38 may include a cast housing. The housing may include an alloy of iron (e.g., nodular, ductile, etc), carbon, and a number of additives such as Si, Al, Cr, Mo, Ni, and Sn.

A second end of the runners 48 is physically coupled to the chamber 36 of the exhaust manifold 38. The first end of the runners 48 is higher (e.g., above in the axial direction) than the second end of the runners 48. In other words, for a vehicle placed on a flat surface, the first end of the runners 48 is axially higher than the second end of the runners 48. In this way, the runners 48 may curve near the first end in order to decrease packaging constraints of the runners 48. However, the runners 48 are susceptible to degradation (e.g., cracks) near the first end due to the curvature, length of installation, and mass supported by manifold flange 56, as described above.

Each of the runners 48 may curve in a different manner toward the chamber 36. Furthermore, each runner may also have a different length to achieve optimum engine performance through exhaust pressure wave tuning. Runners 48 may be a different length, such that the chamber 36 is proximal a first runner and distal to a last runner. In this way, the first runner may be increasingly curved compared to the last runner. Thus, the first runner may be more prone to degradation than the last runner, specifically if significant mass is supported at manifold flange 56 and the last runner is geometrically closest to manifold flange 56. Alternatively, the first runner may be more prone to fatigue degradation due to its position relative to the dynamic excitation and supported mass.

Exhaust manifold 38 further includes a collar 52 located at a junction between one of the runners 48 and the inlet flange 50. The collar 52 is welded via a weld to the first end of one the runners 48 and the inlet flange 50. In one example, the exhaust manifold 38 comprises exactly one collar 52 coupled to exactly one of the runners 48, where other runners do not have a welded collar. In this way, the collar 52 may be physically coupled to the runner 48 directly upstream of the bend/curvature at an exhaust side of the first cylinder head 30. The collar 52 circumferentially surrounds the first end of one of the runners 48 and thus is circularly coupled to the inlet flange 50. Additional details of the structure and function of the collar 52 will be described in greater detail below.

It will be appreciated by someone skilled in the art that one or more of the runners 48 may be coupled to a corresponding collar. Additionally or alternatively, all of the runners 48 may be coupled to a corresponding collar. In this way, a number of collars may be equal to a number of runners 48. Additionally or alternatively, the collars of the one or more runners 48 may be structurally equivalent or inequivalent. If each of the collars is unequal, then the collars may be designed such that they increase a stress balance across all of the runners of the exhaust manifold.

It will also be appreciated by someone skilled in the art that the collar may not be a complete circumferential ring. The collar may be a series of gussets or partial rings spaced apart from one another around a circumference of the exhaust runner in order to distribute a stress load. Additionally the geometry of the collar may be a variety of cross sections including "I", "L", square, or triangular.

Combustion gas expelled from the combustion chambers 26 located in the first cylinder head 30 may be exhausted toward the runners 48 before being directed to the chamber 36, where exhaust gas from each of the cylinder 26 merges and flows through an outlet passage 54. The outlet passage 54 is distal from the runners 48 on an opposite side of the chamber 36. In the present example, outlet passage 54 is parallel to the longitudinal axis. Additionally, the outlet passage 54 terminates with a manifold flange 56. In the present example, a turbocharger casing flange 41 of turbocharger 40 is coupled to the manifold flange 56 to receive exhaust gas from the exhaust manifold 38.

In the present example, turbocharger 40 is coupled to the exhaust manifold 38 at manifold flange 56 via turbocharger casing flange 41. Turbocharger 40 includes a compressor (not shown) arranged along the intake passage and which may be at least partially driven by a turbine 74 (e.g., via a shaft) arranged in exhaust passage 76. The compressor may also be at least partially driven by the engine (e.g., via crankshaft 34) and/or an electric machine. Turbocharger 40 includes a bypass passage 78 with an inlet coupled downstream the turbocharger casing flange 41 and upstream of the turbine 74. An outlet of the bypass passage 78 is coupled downstream of the turbine 74 and upstream of the aftertreatment system 42. A wastegate 80 is disposed within the bypass passage 78. The amount of compression provided to one or more cylinders 26 of the engine via turbocharger 40 may be varied by controller 14 through, for example, control of wastegate 80. For example, the wastegate 80 may be actuated to a more closed position via signals sent from controller 14 to actuators 24 in order to provide a greater amount of compression.

In the present example, exhaust gas that passes through bypass passage 78 or turbine 74 flows to exhaust aftertreatment system 42. Exhaust aftertreatment system 42 is disposed in exhaust passage 76 and may include a three-way catalyst (TWC), diesel oxidation catalyst, particulate filter (PF), selective catalytic reduction (SCR) catalyst, nitrogen oxide trap, sulfur oxide trap, hydrocarbon trap, or combinations thereof. Further examples of engine 10 may include one or both of a low pressure (LP) and a high pressure (HP) exhaust gas recirculation (EGR) loop, along with corresponding valves and sensors.

In one embodiment, additionally or alternatively, the turbocharger 40, turbine 74, and wastegate 78 may be omitted. The engine 10 may include only a compressor (e.g., a supercharger) coupled to one or more of a crankshaft and an auxiliary energy storage unit. In this way, exhaust gas may flow directly to exhaust aftertreatment system 42 without flowing through the turbine 74 or the wastegate 78. Alternatively, the engine 10 may be a naturally-aspirating engine.

FIG. 1 depicts a general schematic for an engine coupled to an exhaust manifold with various components located along an exhaust pathway. FIG. 2 depicts a collar coupled to an inlet flange and an exhaust runner, which may be used in the engine system of FIG. 1.

In an embodiment, exhaust runners with runner walls interfacing with an inlet flange may be adjacent a cylinder head. A collar may be positioned adjacent the interface between a shortest runner and the flange. The collar may form an annular gap around an exterior (e.g., the runner wall) of the runner. The collar may be formed with a single wall extending from the flange to the runner at respective positions spaced away from a corner of the interface, with no further walls exterior to the single wall of the collar. The annular gap may be sealed completely at the respective positions and there are no openings leading to the annular gap from an engine or an ambient environment. In another example, the annular gap may be sealed for a portion at the respective positions, where the annular gap is in fluid communication with the ambient environment. There may be only a single annular gap contained between the collar and an exterior surface of the runner wall. The annular gap extends uninterruptedly fully around an outer circumference of the outer surface of the runner wall. Alternatively, the collar may be segmented such that the annular gap extends interruptedly around the outer circumference of the outer surface of the runner wall.

The embodiment may further comprise, additionally or alternatively, a second, longer runner with another runner wall interfacing with the flange. The second runner does not comprise a collar. In this way, an overall stress caused by a weight and dynamic excitation of the exhaust runners is decreased compared to all the exhaust runners comprising a collar.

Turning now to FIG. 2, an exhaust system 200 comprising a portion of an exhaust manifold 202 is illustrated. The exhaust manifold 202 comprises an inlet flange 204, holes 206, exhaust runners 207, a collar 216, and a collector 218. Exhaust runners 207 include a fourth exhaust runner 208, a third exhaust runner 210, a second exhaust runner 212, and a first exhaust runner 214. In one example, the fourth exhaust runner 208 may be a last exhaust runner, wherein the last exhaust runner is an exhaust runner furthest away from a front of a vehicle.

As described above, the inlet flange 204 is located between an exhaust side of a cylinder head and each of the runners 207. The inlet flange 204 is physically coupled to the cylinder head via stud bolts extending through corresponding holes 206. The stud bolts may be threaded through the holes 206 and into corresponding holes of the cylinder head in order to fasten the inlet flange 204 to the cylinder head. In this way, the inlet flange 204 is in face-sharing contact with and fixed to the cylinder head. In one example, there may be no intervening components located between the inlet flange 204 and the cylinder head. In another example, there may be a gasket for at least sealing between the inlet flange 204 and the cylinder head. Additionally or alternatively, coolant passages may be located in the cylinder head adjacent the inlet flange 204.

Runners 207 extend through corresponding orifices matched in size to cylinder head ports of the inlet flange 204 and are fluidly coupled to corresponding cylinders. In this way, an engine (such as engine 10 shown in FIG. 1) coupled to the inlet flange 204 comprises at least four cylinders. In one example, the engine comprises exactly four cylinders. In another example, the engine comprises exactly eight cylinders, where four cylinders are in a first cylinder bank and the remaining four cylinders are in a second cylinder bank. Thus, as described above, there may be two inlet flanges with runners 207, a first inlet flange with runners coupled to the first bank and a second inlet flange with runners coupled to the second bank.

Exhaust gas exiting combustion chambers of the engine may flow through the inlet flange 204 and into runners 207. For example, a first cylinder may correspond to the first exhaust runner 214. In this way, the exhaust gas from the first exhaust cylinder flows to only the first runner 214 and does not flow to the second, third, or fourth exhaust runners 212, 210, and 208, respectively. Additionally, a second cylinder may correspond to the second exhaust runner 212, a third cylinder may correspond to the third exhaust runner 210, and a fourth cylinder may correspond to the fourth exhaust runner 208, where exhaust gas from a respective cylinder flows to only a corresponding exhaust runner. As shown, the fourth exhaust runner 208 is the shortest of all runners of the manifold/engine, with the third runner 210 being the second shortest, the second runner 212 being the third shortest, and the first runner 214 being the longest. The fourth exhaust runner 208 may be increasingly prone to degradation due to thermal stress. Increased temperatures may cause the runners 207 to expand. However, shorter runners are not able to expand as effectively as longer runners (e.g., the expansion is distributed over a shorter length). As a result, the collar 216 is located on the highest stress runner (e.g., fourth exhaust runner 208). In one example, the collar 216 is welded to only one of the plurality of exhaust runners (e.g., the fourth exhaust runner 208 of the plurality of exhaust runner 207) in order to balance the stress across an entire exhaust manifold 202.

In one example, the first exhaust runner 214 may be closest in proximity to a front of a vehicle. In this way, the fourth exhaust runner 208 may be the farthest from the front of the vehicle (e.g., closest to a rear of the vehicle).

Additionally or alternatively, a collar, such as collar 216, may be located on an exhaust runner with a greatest curve (e.g., a most obtuse bend) or most cantilevered weight, both of which can lead to high stress. In this way, the exhaust manifold 202 may comprise one or more collars with each collar being differently installed with a different length and/or shape. A collar is located on the shortest exhaust runner and/or the runner with the greatest bend. In an alternative example, each of the runners 207 may be coupled to a collar such as collar 216.

The collar 216 is welded to a surface of the inlet flange 204. A cross-section of the weld between the collar 216 and the inlet flange 204 is triangular. The collar 216 is also welded to an outer circumference of the fourth runner 208. The collar 216 is able to help the fourth runner 208 have a parallel (e.g., directed) path for stress that prevents overload or fatigue failure of fourth runner 208. For example, the collar 216 receives a portion of stress directed toward the fourth runner 208 and redirects the stress in a linear direction parallel to a direction of the fourth runner 208.

An entire circumference of the collar 216 may be uninterruptedly welded to an entire circumference of the fourth runner 208 and a surface of the inlet flange 204. Alternatively, half of the entire circumference of the collar 216 may be uninterruptedly welded to the fourth runner 208 and a surface of the inlet flange 204. Alternatively, the collar 216 may be interruptedly welded to the fourth runner 208 and the inlet flange 204, such that welds are separated from one another. In one example, a weld may be a radian or less than a radian apart from an adjacent weld. Thus, the collar 216 may be in fluid communication with an ambient environment. As described above, degradation may occur at the junction between the inlet flange 204 and the fourth runner 208 due to the engine firing and the resulting dynamic excitation. By welding the collar 216 at the junction, the likelihood of degradation decreases due to the collar 216 being able to absorb a portion of stress experienced by the fourth runner 208 since a larger cross sectional area is available at a substantially equal stress level. The collar 216 is also able to bend and flex, similar to a leaf spring, due to an annular air gap located within the collar 216. The above described flexible structure of the collar 216 further balances stress between the collar 216 and the fourth runner 208. The structure of the collar 216 and the air gap will be described in greater detail below, such as with regard to FIGS. 3-5.

As the cylinders of the engine combust, both kinetic energy and thermal energy are transferred to the exhaust runners 207. The collar 216 distributes the kinetic energy and thermal energy received by the fourth exhaust runner 208 in order to extend a longevity of the last exhaust runner 208. The collar 216 distributes the kinetic motion by being able to flex due to the air gap. The collar 216 may retain its structural fidelity as thermal energy may not cross the air gap. For example, a shortest exhaust runner, similar to the last exhaust runner 208, without a collar (e.g., collar 216) may degrade after 75,000 engine cycles. The degradation may include cracks and/or holes, which may lead to exhaust leakage from the degraded runner. However, by welding the collar 216 to the shortest exhaust runner (e.g., the fourth exhaust runner 208), the shortest exhaust runner may degrade after 500,000 engine cycles. Thus, the collar 216 extends the longevity of the shortest exhaust runner by over six fold.

Exhaust gas expelled from the engine cylinders flows through the exhaust runners 207 before flowing to the chamber 220. The chamber 220 is coupled to each of the exhaust runners 207 via the collector 218. In this way, exhaust gas from each cylinder of the engine is maintained separate in each of the exhaust runners 207 until the exhaust gas flow through the collector 218 and into the chamber 220. Therefore, exhaust gas from each of the exhaust runners 207 mixes in the chamber 220 before flowing through an exhaust system (e.g., exhaust system 100).

FIG. 2 depicts an exhaust side of an inlet flange with a single exhaust runner physically coupled to a collar. FIG. 3 depicts a more detailed illustration of the collar being welded to the single exhaust runner and the inlet flange.

Turning now to FIG. 3, a system 300 comprising an inlet flange 302, an exhaust runner 308, and a collar 310 is depicted. The inlet flange 302, the exhaust runner 308, and the collar 310 may be used as the inlet flange 204, the fourth exhaust runner 208, and the collar 216 in the embodiment of FIG. 2 and/or inlet flange 50, the shortest of the runners 48, and collar 52 of the embodiment of FIG. 1, respectively.

The inlet flange 302 comprises an orifice matched to cylinder head port area, where the orifice is directly below a nut 306. The orifice is threaded to receive the nut 306 in order to fasten the inlet flange 302 to a cylinder head (e.g., cylinder head 30 or cylinder head 32). In this way, the inlet flange 302 is coupled to the exhaust side of the cylinder head. Thus, the inlet flange 302 experiences the vibrations and temperature changes created by the engine during combustion, which may also be experienced by the runner 308.

In one embodiment, additionally or alternatively, a coolant jacket may be positioned between the inlet flange 302 and the cylinder head. Coolant in the coolant jacket may not flow to the inlet flange 302. A stud bolt (e.g., nut 306) may extend through an entirety of the coolant jacket and into a receiving hole of the cylinder head. In this way, the inlet flange 302 may be physically coupled to the coolant jacket and the cylinder head without receiving coolant from the coolant jacket.

The runner 308 is fluidly coupled to an exhaust pathway of a single cylinder of the cylinder head via the inlet flange 302. The runner 308 is coupled to the inlet flange 302. Thus, the runner 308 receives combustion products from the single cylinder of the engine and directs the combustion products to a remainder of an exhaust system (e.g., exhaust system 100).

As described above, the runner 308 may be used as the fourth exhaust runner 208 of FIG. 2. Thus, the runner 308 may be the shortest runner of a plurality of exhaust runners. Collar 310 is welded to the runner 308 and the inlet flange 302 to increase a longevity of the runner 308. The collar 310 is depicted with an indentation in order to accommodate the nut 306 and its corresponding orifice. The collar 310 may comprise of one or more suitable materials capable of withstanding thermal energy and kinetic motion generated by operation of a vehicle. For example, the collar 310 may comprise of stainless steel, iron, copper, titanium alloys, nickel alloys, or other suitable compounds.

The collar 310 has an "L-shape" cross-section, as depicted. All of a portion of the collar 310 welded to the exhaust runner 308 extends annularly in an axial direction, perpendicular to a surface of the inlet flange 302. All of a portion of the collar 310 welded to the inlet flange 302 extends annularly in a longitudinal direction, perpendicular to the exhaust runner 308. A central portion 312 of the collar 310 is spaced away from a junction where the exhaust runner 308 and the inlet flange 302 are coupled. An annular air gap is located between an entire circumference of the junction and the collar 310 directly below the central portion 312. The air gap may extend in the axial and longitudinal directions, similar to the collar 310, however, to a lesser degree. In one embodiment, the air gap may be in fluid communication with an ambient environment such that air or other gases may flow in and out of the air gap freely. For example, the collar 310 may be open to the ambient environment near the nut 306. The collar 310 may not be welded to the inlet flange 302 or the runner 308 at portions of the collar 310 in fluid communication with the ambient environment. The air gap will be described in further detail below with respect to FIG. 5.

FIG. 3 depicts a close-up view of a collar welded to both a runner and an inlet flange. FIG. 4 depicts a cross-section of the collar, the exhaust runner, and the inlet flange along the axial axis.

Turning now to FIG. 4, a cross-section 400 comprising an exhaust runner 408 being physically coupled to an inlet flange 402 by an interior weld 404 is illustrated. The cross-section is taken along the axial axis such that an interior of the inlet flange 402, the runner 408, and the collar 410 are depicted. An annular gap 412 is also depicted. The inlet flange 402, nut 406, runner 408, and collar 410 may be used as inlet flange 302, nut 306, runner 308, and collar 310 in the embodiment of FIG. 3, respectively.

As described above, the inlet flange 402 is fastened to an exhaust side of a cylinder head via nut 406. One or more stud bolts, including nut 406, may be used to fasten the inlet flange 402 to the cylinder head.

The runner 408 extends into and is welded to the inlet flange 402 via the interior weld 404. The interior weld 404 is located within an exhaust passage at a junction between an end of the runner 408 and an interior surface of the inlet flange 402. The interior weld 404 is annular and welded to an entire circumference of the runner 408 and the interior surface of the inlet flange 402. The interior weld 404 is beveled such that it does not alter an exhaust gas flow. The interface may be described as a corner (e.g., a 90° angle) created by inserting the runner 408 into a respective hole of the inlet flange 402.

The collar 410 is a single wall extending from the inlet flange 402 and the runner 408 at first and second positions respectively. The first and second positions are spaced away from the runner 408. The collar 410 extends around an entire circumference of the outer surface of the runner 408. Weld beads 414 are used to weld portions of the collar 410 to portions of the first and second positions. The weld beads 414 are spaced apart such that the annular gap 412, between the collar 410, the runner 408, and the inlet flange 402, may remain in fluid communication with a surrounding ambient environment. Additionally, the collar 410 may maintain a degree of flexibility while being welded to both the runner 408 and the inlet flange 402.

The weld beads 414 may be located around an entire circumference of the collar 410, welded to both the runner 408 and the inlet flange 402. The weld beads 414 coupled to the collar 410 and the runner 408 are not coupled to the inlet flange 402. Likewise, weld beads 414 coupled to the collar 410 and the inlet flange 402 are not coupled to the runner 408. Thus, there are two sets of weld beads 414. Weld beads 414 may be spherical, triangular, rectangular, contoured, or other suitable shapes capable of welding the collar 410 to the runner 408 and the inlet flange 402.

The annular gap 412 is annular and surrounds an entire circumference of the outer surface of the runner 408. The annular gap 412 extends uninterruptedly around fully around the runner 408. As described above, the annular gap 412 may be in fluid communication with the surrounding ambient environment. In this way, hotter gas from the ambient environment may flow out of the annular gap 412 and be replaced by cooler gas from the ambient environment. Cut-out 416 shows a region of the collar 410 contoured to accommodate the nut 406. The collar 410 is spaced vertically away from the inlet flange 402 at a location of the cut-out 416. Therefore, the cut-out may be an example of a location where the annular gap 412 is in fluid communication with the ambient environment. The cut-out 416 will be described in more detail with respect to FIG. 6.

The annular gap 412 may allow the collar 410 to flex and/or bend in response to stress. For example, as the engine combusts, kinetic motion may be transferred to the inlet flange 402, the runner 408, and the collar 410. The collar 410 is designed to absorb a portion of stress received by the inlet flange 402 and the collar 410 by increasing the cross sectional area and acting as a spring (e.g., a leaf spring) in order to decrease a likelihood of degradation at the interface. The collar 410 may flex and/or bend between its first and second respective positions toward and away from the annular gap 412.

As another example, thermal energy may be transferred to the inlet flange 402, the runner 408, and the collar 410. The thermal energy may cause the inlet flange 402, the runner 408, and/or the collar 410 to thermally expand, which may lead to degradation. The collar 410 may be cooler than the inlet flange 402 and the runner 408 due to the annular gap 412. In this way, the collar 410, the runner 408, and the inlet flange 402 may undergo heat transfer with the annular gap 412 in order to decrease a temperature increase due to combustion. By decreasing a temperature of the collar 410, the runner 408, and the inlet flange 402, a life-expectancy of the aforementioned components may be increased. As described above, the increase may be five-fold.

FIG. 4 depicts a three-dimensional cross-section of a collar welded to both an exhaust runner and an inlet flange. FIG. 5 depicts a two dimensional cross-section of the collar, the runner, and the inlet flange along a longitudinal axis.

Turning now to FIG. 5, a side-on cross-section 500 of an inlet flange 502, a runner 504, a collar 506, and an annular gap 510 are illustrated. The inlet flange 502, the runner 504, the collar 506, and the annular gap 510 may be used as the inlet flange 402, the runner 408, the collar 410, and the annular gap 412 in the embodiment of FIG. 4.

The collar 506 is a single wall welded to a first point on an outer surface of the inlet flange 502. Likewise, the collar 506 is welded to a second point on an outer surface of the runner 504. As described above, the collar 506 is annular and surrounds an outer circumference of the runner 504. As shown, a thickness of the runner wall 504 is thicker than a thickness of the collar 506.

The collar 506 resembles a saddle-shape and is smoothly welded to the first and second points. For example, the collar 506 is beveled near the first and second points such that an acute angle is formed between the first point and the collar 506 and the second point and the collar 506. Said another way, the collar 506 has convex and concave exterior surfaces to from a smooth connection between the runner 504 and the flange 502. As a result, the collar 506 may be flexible.

The collar 506 comprises weld beads 508A and 508B near the first and second points, respectively. The weld bead 508A couples the collar 506 to the flange 502 and the weld bead 508B couples the collar 506 to the runner 504. The weld beads 508A and 508B physically couple the collar 506 at the first and second points, respectively, while allowing the collar 506 flex and/or bend along a central portion adjacent the air gap 510 in order to dissipate a stress load created during engine operation.

Additionally or alternatively, the collar 506 may be a different geometrical cross-sections, including L-shaped, triangular, I-shaped, square, arched, contoured, and other suitable shapes. Furthermore, the collar 506 may not fully extend in a circumferential direction around the runner 504. In one example, the collar 506 may be a plurality of segmented portions evenly or unevenly circumferentially spaced around the circumference of the runner 504. In this way, a plurality of interrupted annular gaps 510, equal to a number of collars 506, may exist.

The annular gap 510 is located between the collar 506, the inlet flange 502, and the runner 504. The annular gap 510 may be similarly shaped to the collar 506. The annular gap 510 may be coupled to a greater area of the outer surface of the runner 504 compared to inlet flange 502.

Turning now to FIG. 6, a side-on cross-section 600 of a flange 602, a runner 604, a collar 606, an annular bead 608, an annular gap 610, a nut 612, and a cut-out 614 is shown illustrating an open space. The inlet flange 602, the runner 604, the collar 606, and the annular bead 608 may be used as flange 502, runner 504, collar 506, and annular bead 508A in the embodiment of FIG. 5, and in this example FIGS. 5 and 6 show the same components but at different cross-sections axially around the central axis of the runner.

The collar 606 is physically coupled to the flange 602 via the bead 608. However, the collar 606 is not physically coupled to the runner 604. The collar 606 is vertically spaced away from the runner 604 along the axial axis in order to accommodate the nut 612. The collar 606 accommodates the nut 612 via the cut-out 614. The annular gap 610 is in fluid communication with an ambient environment as a result of the cut-out 614. The cut-out 614 may be defined by edges parallel to the axial axis or oblique to the axial axis. In this way, a collar spaced away from a corner of an interface between a flange and a runner may decrease a likelihood of degradation. An annular gap is located between the collar, the flange, and the runner, which may allow the collar to bend in response to absorbing a portion of a stress load at the interface. By doing this, the stress load received by the runner may be more evenly distributed. By coupling the collar to only a single runner of a plurality of runners, a weight load of the runners is decreased compared to a collar being coupled to all of the plurality of runners. The technical effect of coupling a collar to a single runner of a plurality of runners at an interface between a wall of the single runner and the flange is to decrease a likelihood of degradation.

Both FIGS. 5 and 6 illustrate various faces of components directly contacting one another an in face-sharing contact (e.g., the bottom surface of 506 and the top surface of 504 at a crossectional location away from the nut), as well as certain surfaces not directly contacting one another (e.g., the bottom surface of 606 not contacting the top surface of 604 at the particular cross-sectional location at the nut 612.

In a first example, the present application contemplates an exhaust system comprising a runner having a runner wall interfacing with an inlet flange of a cylinder head and a collar positioned at the interface forming an annular air gap around an exterior surface of the runner.

In a first embodiment, the exhaust system of the first example may include where the air gap is narrower along the wall of the runner than along the exhaust flange.

In a second embodiment, which optionally includes the first embodiment, the exhaust system of the first example may form the collar with a single wall extending from the flange to the runner at respective positions spaced away from a corner of the interface, with no further walls exterior to the single wall.

In a third embodiment, which optionally includes the first and second embodiments, the air gap may be sealed completely at the respective positions and there are no openings leading to the air gap from the engine or the ambient environment.

In a fourth embodiment, which optionally includes one or more of the first through third embodiments, the exhaust system of the first example further comprises an interior weld coupling the runner and the flange in an exhaust passage and not contacting the collar.

In a fifth embodiment, which optionally includes one or more of the first through fourth embodiments, the exhaust system of the first example further comprises a cylinder head having a coolant jacket therein, where no coolant of any coolant jacket in the cylinder head is fluidically coupled with the air gap.

In a sixth embodiment, which optionally includes one or more of the first through fifth embodiments, there is only a single air gap contained between the collar and the exterior surface of the runner wall.

In a seventh embodiment, which optionally includes one or more of the first through sixth embodiments, the collar has convex and concave exterior surfaces to form a smooth connection between the wall and the flange.

In an eighth embodiment, which optionally includes one or more of the first through seventh embodiments, the air gap extends uninterruptedly fully around an outer circumference of the exterior surface of the runner wall.

In a ninth embodiment, which optionally includes one or more of the first through eighth embodiments, a thickness of the collar wall is less than a thickness of the runner wall.

In a tenth embodiment, which optionally includes one or more of the first through ninth embodiments, the exhaust system of the first example further comprising another runner wall of another runner interfacing with the inlet flange, the another runner not having a collar and not having an air gap.

In an eleventh embodiment, which optionally includes one or more of the first through tenth embodiments, the another runner is longer in length leading to a junction at a collector than the runner.

In a twelfth embodiment, which optionally includes one or more of the first through eleventh embodiments, the exhaust system of the first example further comprises a cylinder head having a plurality of cylinder openings, wherein each exhaust runner of each cylinder is separated from one another before leading to a common junction at a collector.

In a thirteenth embodiment, which optionally includes one or more of the first through twelfth embodiments, each runner is bent differently.

In a fourteenth embodiment, which optionally includes one or more of the first through thirteenth embodiments, each runner is welded together with other runners to form an exhaust manifold.

In a second example, the present application contemplates a system comprising an annular collar welded around an entire circumference of an individual exhaust runner of a plurality of exhaust runners and an inlet flange on an exhaust side of a cylinder head, where the collar is spaced away from a corner of an interface between a wall of the exhaust runner and the inlet flange.

In a first embodiment, the system of the second example includes where the system additionally or alternatively includes an annular air gap located between the corner, the inlet flange, the exhaust runner, and the collar.

In a second embodiment, which optionally include the first embodiment, the collar is flexible.

In a third example, the present application contemplate a system comprising a plurality of separate exhaust runners fluidly coupled to respective cylinders via an inlet flange on an exhaust side of a cylinder head, where the plurality of exhaust runners are maintained separate upstream of a collector a collar circumferentially welded to a shortest runner of the plurality of exhaust runners and to the inlet flange, and an air gap located between the collar, the shortest runner, and the inlet flange, where the air gap is interruptedly sealed from an ambient atmosphere and an engine. In a first embodiment, the system of the third example includes where the system additionally or alternatively includes the collar is welded to the plurality of exhaust runners.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An exhaust system, comprising:

a runner having a runner wall interfacing with an inlet flange of a cylinder head and a collar positioned at an interface forming an annular air gap around an exterior surface of the runner, wherein the collar is formed with a single wall extending from the inlet flange to the runner at respective positions spaced away from a corner of the interface, with no further walls exterior to the single wall, and the air gap is sealed around a portion of the runner circumference and there are interrupted openings leading to the air gap from an engine or ambient environment.

2. The system of claim 1, wherein the air gap is narrower along the wall of the runner than along an exhaust flange.

3. The system of claim 1, further comprising weld beads at the portion, the weld beads physically coupling the collar directly to the inlet flange and the runner.

4. The system of claim 1, further comprising one or more coolant jackets included in the cylinder head, where no coolant of any coolant jackets in the cylinder head is fluidically coupled with the air gap.

5. The system of claim 1, wherein there is only a single air gap extending uninterruptedly between the collar and fully around an outer circumference of the exterior surface of the runner wall.

6. The system of claim 1, wherein the collar has convex and concave exterior surfaces to form a smooth connection between the runner wall and the inlet flange.

7. The system of claim 1, wherein a number of air gaps is equal to a number of segmented collars.

8. The system of claim 1, wherein a thickness of a collar wall is less than a thickness of the runner wall.

9. The system of claim 1, further comprising another runner wall of another runner interfacing with the inlet flange, the another runner not having a collar and not having an air gap.

10. The system of claim 9, wherein the another runner is longer in length leading to a junction at a collector than the runner.

11. The system of claim 1, where the cylinder head includes a plurality of cylinder openings, and wherein the runner leads to a common junction at a collector.

12. A system, comprising:

an annular collar welded around an entire circumference of an individual exhaust runner of a plurality of exhaust runners and an inlet flange on an exhaust side of a cylinder head, where the collar is spaced away from a corner of an interface between a wall of the exhaust runner and the inlet flange, wherein the collar is formed with a single wall extending from the inlet flange to the exhaust runner at respective positions spaced away from a corner of the interface, with no further walls exterior to the single wall and an air gap is sealed around a portion of the exhaust runner circumference and there are interrupted openings leading to the air gap from an engine or ambient environment.

13. The system of claim 12, further comprising the air gap located between the corner, the inlet flange, the exhaust runner, and the collar.

14. The system of claim 12, wherein the collar is flexible.

15. A system, comprising:

a plurality of separate exhaust runners fluidly coupled to respective cylinders via an inlet flange on an exhaust side of a cylinder head, where the plurality of exhaust runners is maintained separate upstream of a collector;

a collar circumferentially welded to a shortest runner of the plurality of exhaust runners and to the inlet flange; and an air gap located between the collar, the shortest runner, and the inlet flange, where the air gap is in fluid communication with an ambient atmosphere and an engine.

16. The system of claim 15, wherein the collar is one of a plurality of collars, and where each collar of the plurality of collars is welded to the plurality of exhaust runners.

* * * * *